US010060706B2

(12) United States Patent
Jeung et al.

(10) Patent No.: US 10,060,706 B2
(45) Date of Patent: Aug. 28, 2018

(54) TRAJECTORY CORRECTING DEVICE AND SIGHT DEVICE HAVING THE SAME

(71) Applicant: Bo Sun Jeung, Bucheon-si, Gyeonggi-do (KR)

(72) Inventors: Bo Sun Jeung, Bucheon-si (KR); In Jung, Bucheon-si (KR); Dong Hee Lee, Seongnam-si (KR)

(73) Assignee: Bo Sun Jeung, Bucheon-si, Gyeonggi-Do (KR)

( * ) Notice: Subject to any disclaimer, the term of this patent is extended or adjusted under 35 U.S.C. 154(b) by 0 days.

(21) Appl. No.: 15/623,203

(22) Filed: Jun. 14, 2017

(65) Prior Publication Data

US 2017/0356722 A1 Dec. 14, 2017

(30) Foreign Application Priority Data

Jun. 14, 2016 (KR) ..... 10-2016-0073677
Jun. 12, 2017 (KR) ..... 10-2017-0073240

(51) Int. Cl.

| | |
|---|---|
| ***F41G 11/00*** | (2006.01) |
| ***F41G 1/28*** | (2006.01) |
| ***F41G 1/473*** | (2006.01) |
| *F41G 1/38* | (2006.01) |
| *F41G 1/30* | (2006.01) |

(52) U.S. Cl.

CPC ..... *F41G 11/003* (2013.01); *F41G 1/28* (2013.01); *F41G 1/473* (2013.01); *F41G 1/30* (2013.01); *F41G 1/38* (2013.01)

(58) Field of Classification Search

CPC ... F41G 1/16; F41G 1/38; F41G 1/387; F41G 1/393; F41G 1/3935; F41G 1/44; F41G 1/473; F41G 1/28; F41G 3/02; F41G 3/08; F41G 3/10; F41G 5/00; F41G 5/02; F41G 11/005; F41G 11/006; F41G 11/007

USPC ..... 42/115, 124, 125, 126, 135, 136, 137, 42/138

See application file for complete search history.

(56) References Cited

U.S. PATENT DOCUMENTS

| | | | | | |
|---|---|---|---|---|---|
| 906,751 | A | * | 12/1908 | Swasey | F41G 1/28 42/126 |
| 1,003,115 | A | * | 9/1911 | Korrodi | F41G 3/10 89/206 |
| RE14,009 | E | * | 11/1915 | Warner | F41G 1/28 33/38 |
| 1,235,172 | A | * | 7/1917 | Warner et al. | F41G 1/26 42/137 |
| 1,459,944 | A | * | 6/1923 | Belding | F41G 11/003 42/126 |
| 2,336,107 | A | * | 12/1943 | Litschert | F41G 11/002 116/67 R |
| 2,548,031 | A | * | 4/1951 | Leupold | F41G 11/001 403/188 |

(Continued)

*Primary Examiner* — Derrick R Morgan
(74) *Attorney, Agent, or Firm* — Baker & McKenzie LLP

(57) ABSTRACT

A trajectory correcting device includes a first trajectory adjustment mechanism and a second trajectory adjustment mechanism. The first trajectory adjustment mechanism is configured to change an angle between a mounting member and a sight or a second mounting member. The second trajectory adjustment mechanism is configured to rotate the sight or mounting member about an axis different than the adjustment axis of the first trajectory adjustment mechanism.

21 Claims, 16 Drawing Sheets

(56) References Cited

U.S. PATENT DOCUMENTS 2,621,410 A * 12/1952 Street ..... F41G 11/002 42/126
3,867,764 A * 2/1975 Dunmire ..... F41G 1/35 33/DIG. 21
3,922,794 A * 12/1975 Ackerman, Jr. ..... F41G 1/26 42/126
3,979,848 A * 9/1976 Ackerman, Jr. ..... F41G 1/26 42/126
4,742,636 A * 5/1988 Swan ..... F41G 11/006 42/126
4,940,324 A * 7/1990 Nichols ..... F41G 1/30 356/247
5,388,335 A * 2/1995 Jung ..... F41G 1/26 42/115
5,625,954 A * 5/1997 DePaoli ..... F41G 1/345 42/113
6,568,118 B1 * 5/2003 Teetzel ..... F41G 1/36 42/105
6,622,415 B1 * 9/2003 Canaday ..... F41G 1/26 42/112
7,647,720 B1 * 1/2010 Vendetti ..... F41G 1/28 42/126
8,296,991 B1 * 10/2012 Chung ..... F41G 1/35 42/111
8,327,574 B2 * 12/2012 Sandler ..... F41G 11/003 42/126
8,407,924 B2 * 4/2013 Lee ..... F41G 1/473 42/111
8,413,365 B2 4/2013 Jung et al.
8,707,606 B2 * 4/2014 Hoel ..... F41G 11/003 42/124
8,984,795 B2 * 3/2015 Jung ..... F41G 1/30 42/113
9,057,584 B2 * 6/2015 Chung ..... F41G 1/16
9,423,212 B2 * 8/2016 Campean ..... F41G 1/18
2006/0010759 A1 * 1/2006 Penney ..... F41G 11/001 42/126
2006/0179704 A1 * 8/2006 Dextraze ..... F41G 1/393 42/126
2010/0162611 A1 * 7/2010 Samson ..... F41G 1/18 42/125
2010/0175295 A1 * 7/2010 Hoel ..... F41G 11/003 42/90
2010/0275495 A1 * 11/2010 Jung ..... F41G 1/30 42/113
2011/0041378 A1 * 2/2011 Rozitis ..... F41G 11/003 42/125
2011/0114725 A1 * 5/2011 Young ..... F41G 1/033 235/407
2011/0154713 A1 * 6/2011 Jung ..... F41G 1/30 42/137
2012/0131839 A1 * 5/2012 Dextraze ..... F41G 1/393 42/90
2012/0240446 A1 * 9/2012 Lee ..... F41G 1/30 42/115
2013/0008072 A1 * 1/2013 Chung ..... F41G 1/16 42/113
2015/0198421 A1 * 7/2015 Crispin ..... F41G 11/006 42/126
2016/0216071 A1 * 7/2016 Bernard ..... F41G 1/393
2017/0248389 A1 * 8/2017 DiCarlo ..... F41G 11/003

* cited by examiner

TRAJECTORY CORRECTING DEVICE AND SIGHT DEVICE HAVING THE SAME

CROSS REFERENCE TO RELATED APPLICATION

This application claims the benefit of Korean Patent Application No. 10-2016-0073677 filed Jun. 14, 2016 and Korean Patent Application No. 10-2017-0073240 filed Jun. 12, 2017, the entire contents of which are incorporated herein by reference.

BACKGROUND

The present disclosure relates to a bullet trajectory correcting device and a sight device having the same.

In firearms, bullet trajectories are affected by external factors such as inertia from a velocity of a bullet coming out of a muzzle, air resistance in the atmosphere, gravitational acceleration of Earth, the Coriolis force caused by rotation of Earth, and deflecting force.

Particularly, trajectories of grenades are affected by gravity in the vertical direction and affected by the Coriolis force in the horizontal direction. In the vertical direction, a grenade that has left the muzzle falls down in a parabolic form due to gravity, and in the horizontal direction, the grenade is deflected rightward with respect to a traveling direction of the bullet, for example, in the northern hemisphere. For this reason, the grenade greatly deviates from an aiming point, and the grenade does not hit the target accurately.

Grenade launchers with a large curvature trajectory such as K4 grenade launchers or MK-19 grenade launchers are configured to move vertically with a large angle and have a function of correcting an elevation angle thereof.

However, the grenade launchers or the sight devices according to the related art have no function of correcting an error in a horizontal trajectory caused by the Coriolis force. As the distance to the target increases, the error in the horizontal trajectory increases, and the hit accuracy decreases.

In this regard, it is desirable to provide a trajectory correcting device and a sight device having the same, which are capable of correcting the error in the horizontal bullet trajectory caused by the Coriolis force in addition to the vertical bullet trajectory.

Further, it is desirable to provide a trajectory correcting device having a simple configuration and a sight device having the same.

BRIEF SUMMARY

According to certain embodiments of the present disclosure, a trajectory correcting device and a sight device having the same are provided that are capable of correcting the error in the horizontal trajectory caused by the Coriolis force in addition to the vertical bullet trajectory.

In addition, a trajectory correcting device having a simple configuration and a sight device having the same are described.

In an example, a trajectory correcting device includes a first mounting member, a second mounting member, a first trajectory adjustment mechanism and a second trajectory adjustment mechanism. The first mounting member is configured to releasably couple with a firearm. The second mounting member is configured to releasably couple with a sight. A vertical axis is defined as extending in a direction from the mounting member toward the second mounting member. The first trajectory adjustment mechanism is configured to change an angle between the mounting member and the second mounting member. The second trajectory adjustment mechanism configured to rotate the second mounting member with respect to the first mounting member about the vertical axis.

In another example, a sighting device includes a sight, a mounting member, a movable member, a first trajectory adjustment mechanism, and a second trajectory adjustment mechanism. The sight includes a zeroing mechanism that adjusts both and elevation and windage zero point. The mounting member is configured to releasably couple with a firearm. The movable member is coupled between the sight and the mounting member. The first trajectory adjustment mechanism is distinct from the zeroing mechanism and configured to change an angle between the sight and the mounting member. The second trajectory adjustment mechanism distinct from the zeroing mechanism and configured to rotate the sight about an axis different than the adjustment axis of the first trajectory adjustment mechanism.

DETAILED DESCRIPTION

Hereinafter, exemplary embodiment of the present disclosure will be described in detail with reference to the appended drawings.

In this specification, the term "bullet" will be understood to include grenades and refer to a bullet affected in the vertical direction by gravity and also in the horizontal direction by the Coriolis force. In the following discussion, a trajectory correcting device includes a bullet trajectory device such as for grenades and other bullet-like projectiles.

Figure 3A:
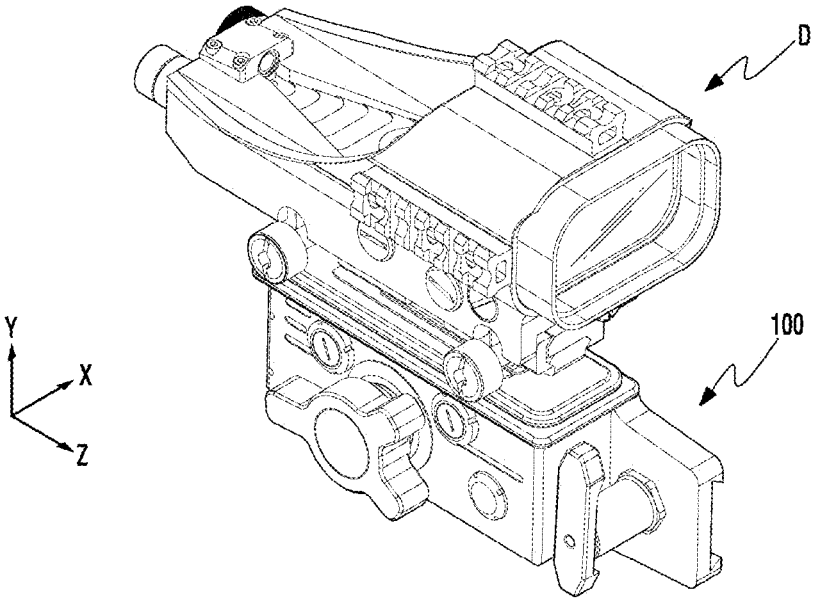
FIG. 3A is a perspective view illustrating a sight device removably attached to a trajectory correcting device according to an embodiment of the present disclosure.
Figure 3B:
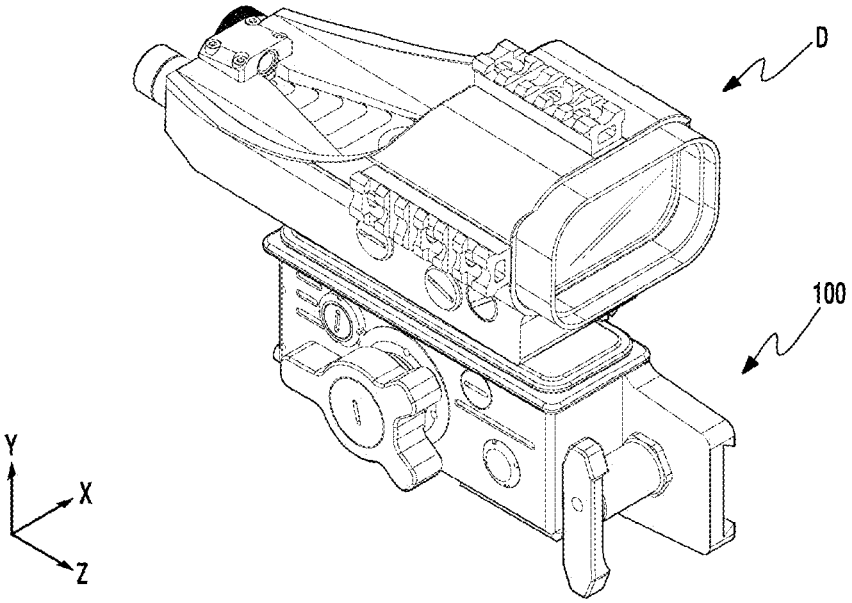
FIG. 3B is a perspective view illustrating a sight device integrally formed with a trajectory correcting device according to an embodiment of the present disclosure.

FIGS. 3A and 3B are diagrams illustrating exemplary sight devices including a trajectory correcting devices, respectively.

Referring to FIG. 3A, a trajectory correcting device 100 is removably attached to a sight device D via a mounting member such as a picatinny rail. Any type of sight device can be used as the sight device D, and a sight device to which the trajectory correcting device 100 is attached is not particularly limited. For the sake of convenience, this description will proceed with an example of a dot sight device but it will be understood that the type of sight device is not limited thereto. The dot sight device D may include a light source that emits light and a reflective mirror that reflects the light emitted from the light source toward the user and forms a dot reticle image thereon. The dot sight device D may include a zeroing mechanism that adjusts both and elevation and windage zero point. Using the dot sight device D, the user can easily aim at the target by aligning the dot reticle image with the target.

The bullet trajectory correcting device 100 may be formed integrally with the sight device D as illustrated in FIG. 3B. Hereinafter, description will proceed with a configuration in which the bullet trajectory correcting device 100 is removably attached to the sight device D via a mounting member such as a picatinny rail.

Figure 4:
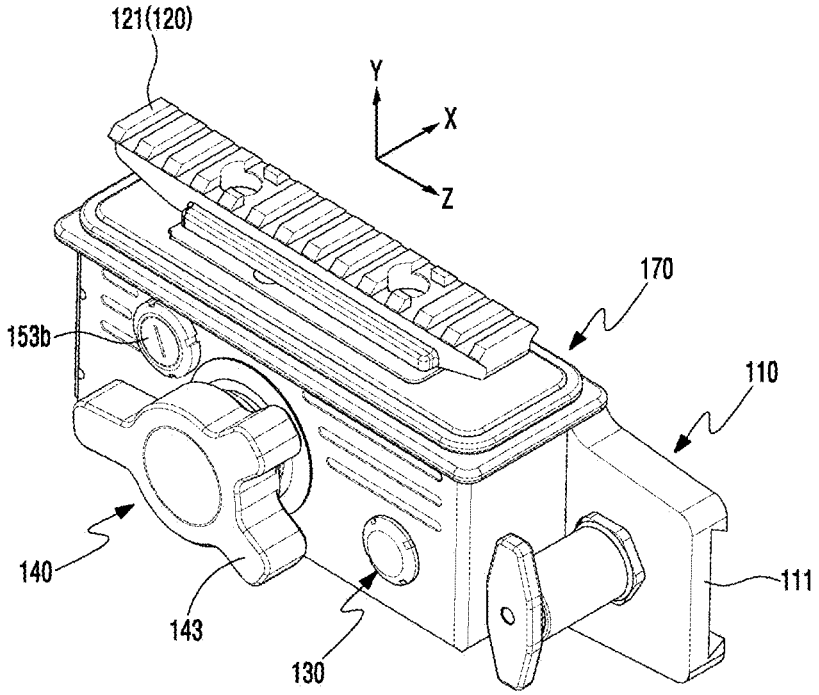
FIG. 4 is a perspective view illustrating a trajectory correcting device according to an embodiment of the present disclosure.
Figure 5:
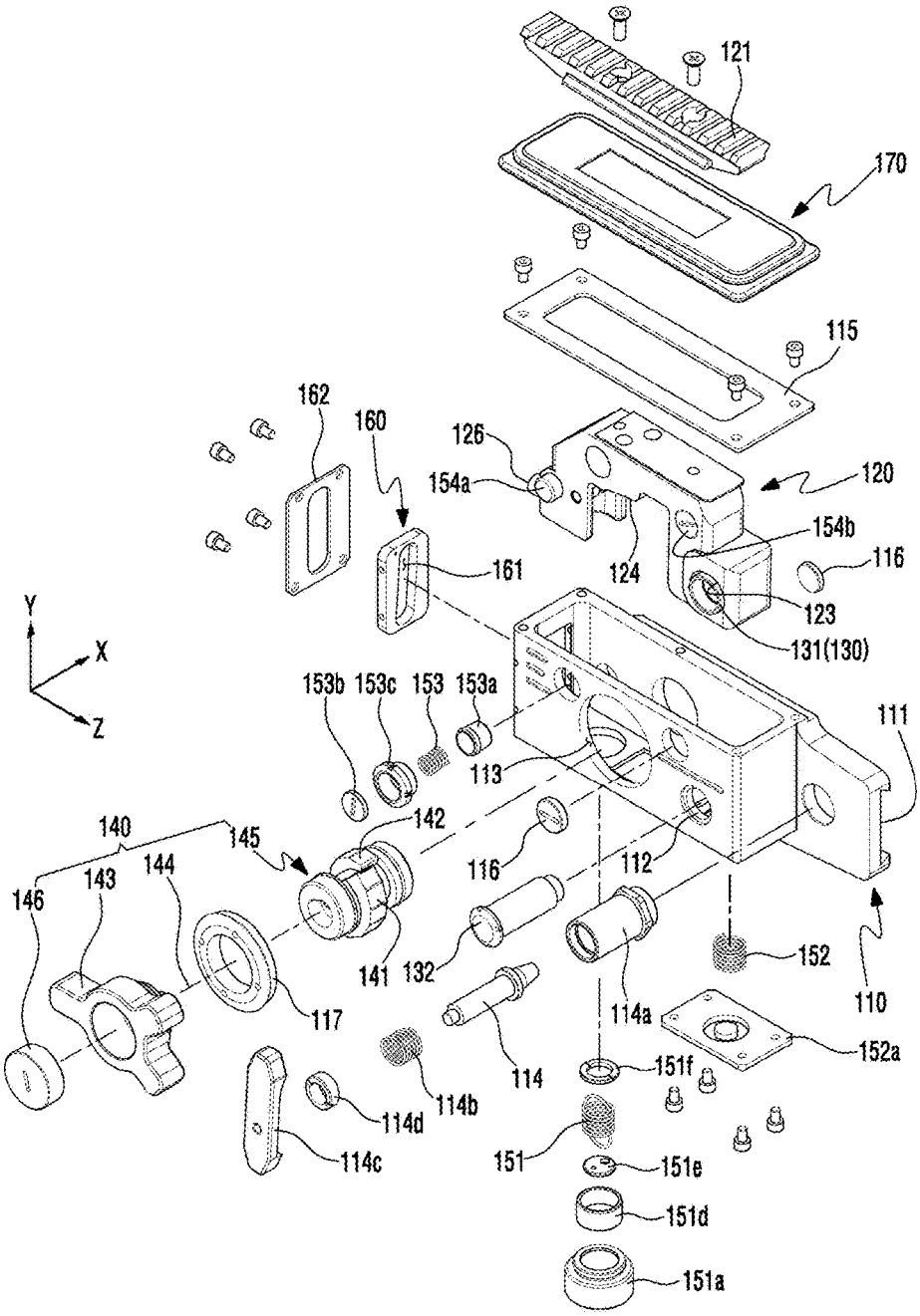
FIG. 5 is an exploded perspective view of a trajectory correcting device according to an embodiment of the present disclosure.
Figure 6:
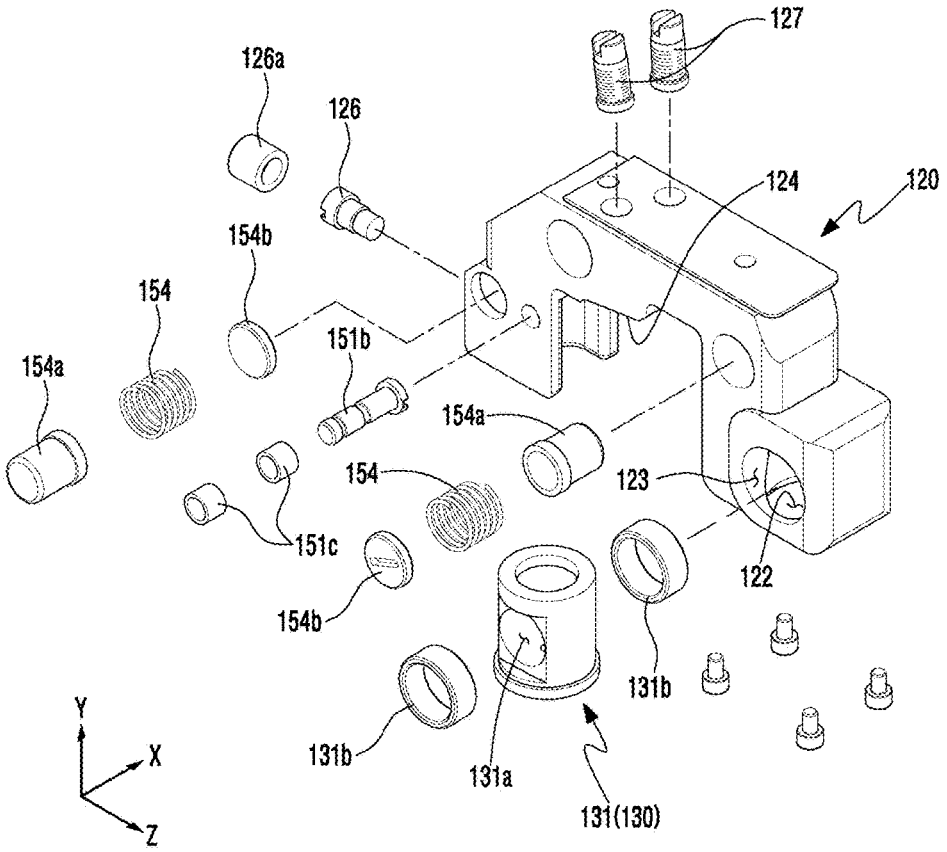
FIG. 6 is an exploded perspective view of components of a trajectory correcting device according to an embodiment of the present disclosure.
Figure 7:
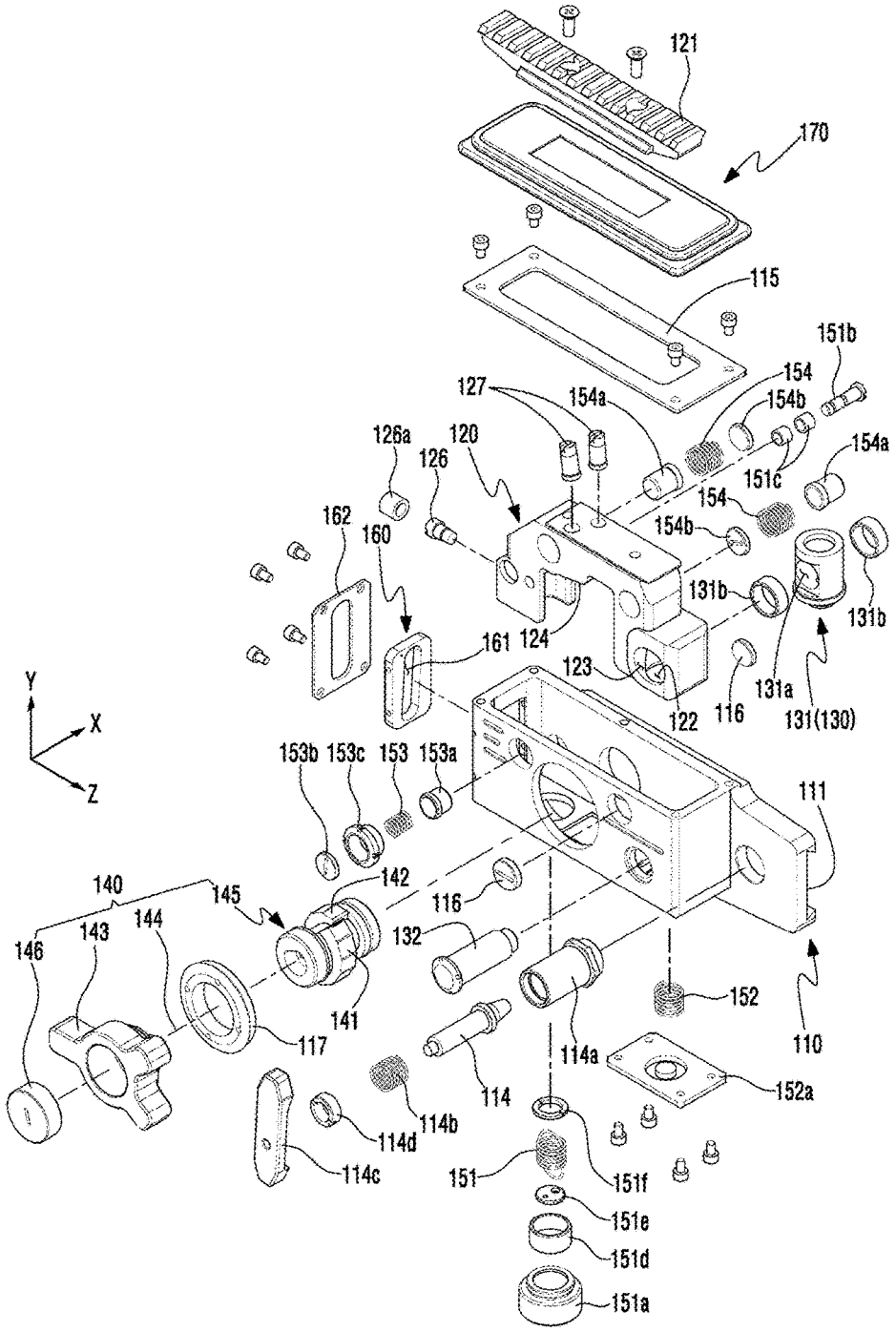
FIG. 7 is an exploded perspective view of a trajectory correcting device according to an embodiment of the present disclosure.

FIG. 4 is a perspective view and FIGS. 5 to 7 are exploded perspective views illustrating a trajectory correcting device 100 according to an embodiment of the present disclosure.

As illustrated in FIGS. 4 to 7, the bullet trajectory correcting device 100 includes a housing 110, a movable member 120, a joint portion 130, an adjusting member 140, a guide member 160, and a sealing portion 170.

The housing 110 includes a first fixing portion 111 formed at a side surface thereof in a third axis (Z axis) direction parallel to a barrel (not illustrated) and detachably coupled to a firearm, for example, a grenade launcher. An internal space is formed inside the housing 110 and accommodates the movable member 120. An opening portion of the first fixing portion 111 is opened upwards. A first support hole 112 is formed extending in a first axis (X axis) direction and rotatably supports a second rotating shaft 132 of the joint portion 130 inserted therein. A second support hole 113 is formed extending in the first axis (X axis) direction at a position spaced apart from the first support hole 112 and supports the adjusting member 140.

The housing 110 includes a fixing shaft hole into which a fixing shaft 114 is inserted via a fixing shaft housing 114*a*. The fixing shaft 114 selectively limits movement of the first fixing portion 111 in the third axis (Z axis) direction in a state in which the first fixing portion 111 is mounted on the firearm.

The fixing shaft 114 includes a leading end that is inserted into the fixing shaft hole and is elastically supported in the X axis direction by an elastic member 114*b* interposed between a first fixing ring 114*d* fixed to the fixing shaft housing 114*a* and the leading end of the fixing shaft 114. A knob 114*c* is coupled to a rear end of the fixing shaft 114 so that the user can pull and insert the fixing shaft 114 in the X axis direction. In other words, the fixing shaft 114 is movable in the first axis (X axis) direction via the fixing shaft housing 114*a* coupled to the housing 110. A method of fixing the bullet trajectory connecting device to the firearm using the fixing shaft 114 will be described later in detail.

A housing cover 115 is coupled to the opening portion of the housing 110, for example, using screws.

The movable member 120 is disposed in the internal space of the housing 110 and includes a second fixing portion 121, which is exposed to the outside through the opening portion of the housing 110. The second fixing portion couples with the sight device D, and couples to the body of the movable member 120, for example, via screws. An insertion hole 122 which is formed in the movable member 120 in the second axis (Z) axis direction rotatably supports a first rotating shaft 131 inserted therein. A through hole 123 extends into the insertion hole 122 in the first axis (X axis) direction and receives the second rotating shaft 132 inserted therein. A first guide surface 124 comes into contact with a first cam 141 of the adjusting member 140. A second guide surface 125 (see also FIG. 8B) comes into contact with a second cam 142, and a guide protrusion 126 engages with the guide member 160 for horizontal trajectory correction. The guide protrusion 126 includes a sleeve 126*a* that is rotatably supported on the guide protrusion 126 to reduce friction with the guide member 160.

Preferably, the through hole 123 may have a long-hole shape to reduce or prevent interference with the second rotating shaft 132 when the movable member 120 turns on the first rotating shaft 131 in the X axis direction.

Further, screw-like trajectory supports 127 may be coupled with the movable member 120. As the screw-like trajectory supports 127 are fastened, the screw-like trajectory supports 127 protrude from the first guide surface 124 and the second guide surface 125 and come into contact with support surfaces of the first cam 141 and the second cam 142, which may be selected by the user rotating the adjusting member 140. The trajectory supports 127 function to adjust protrusion distances from the first guide surface 124 and the second guide surface 125 as they are fastened or loosened.

Accordingly, the vertical movement of the movable member 120 can be adjusted by the trajectory supports 127 with a high degree of accuracy, and vertical trajectory correction accuracy can be improved.

Four elastic members 154 are respectively disposed on both sides of the movable member 120 to elastically support the outer surface of the movable member 120 against the inner surface of the housing 110.

In the present embodiment, pressing protrusions 154*a* are slidably coupled to on both sides of the movable member 120 in the first axis (X axis) direction. The pressing protrusions 154*a* are supported by the elastic member 154 and elastically comes in close contact with the inner wall surface of the housing 110. The rear end of the elastic member 154 is supported by a fourth spring cover 154*b* coupled to the movable member 120 in a screw-like fashion. However, the present disclosure is not limited to this example.

Particularly, one of a pair of the elastic members 154 disposed on both sides of the movable member 120 is disposed at a position apart from an imaginary line connecting the second rotating shaft 132 with the other elastic member 154 of the pair on a Y-Z plane.

In other words, since the movable member 120 is supported to the housing 110 at three points by the second rotating shaft 132 and the two elastic members 154, it is possible to reduce or prevent the movable member 120 from being shaken loose in the housing 110 due to an assembly tolerance.

The joint portion 130 includes the first rotating shaft 131 and the second rotating shaft 132 connecting the housing 110 and the movable member 120 so that the movable member 120 can turn left, right, up, or down, that is, in the Y axis direction or the X axis direction in the housing 110.

The first rotating shaft 131 is rotatably inserted into the insertion hole 122 of the movable member 120 and functions as a central axis of the left-right rotation of the movable member 120. A through hole 131*a* orthogonal to the axial direction of the first rotating shaft 131 is formed on the side of the first rotating shaft 131.

The second rotating shaft 132 is inserted into the through hole 131*a* of the first rotating shaft 131 in a state in which it is supported by the first support hole 112 of the housing 110.

Further, a spacer 131*b* for stably supporting the second rotating shaft 132 is preferably disposed on both sides of the through hole 131*a* of the first rotating shaft 131.

The movable member 120 is elastically supported by a first elastic member 151 interposed between the movable member 120 and the housing 110 to maintain a state in which the first cam 141 comes into close contact with the first guide surface 124 or a state in which the second cam 142 comes into close contact with the second guide is maintained.

In the present embodiment, the first elastic member 151 may be a tension spring that applies elastic force (indicated by an arrow in FIG. 8). One end of the first elastic member 151 is rotatably connected to a spring cap 151*a* disposed on the housing 110 side. The other end portion of the first elastic member 151 is connected to a spring shaft 151*b* disposed on the movable member 120 side. A spring guide 151*c* for guiding a coupling position of the first elastic member 151 is disposed on both sides of the center of the spring shaft 151*b*. However, any other type of spring can be used as long as an elastic force to maintain a state in which the movable member 120 is elastically in close contact with the adjusting member 140 is provided.

The spring cap 151*a* includes a first spring cover 151*d* rotatably supported on the spring cap 151*a*, a rotating plate 151*e* which is rotatably received in the first spring cover 151*d* and fixed to one end of the first elastic member 151, and a second fixing ring 151*f* which is coupled to an opening portion of the first spring cover 151*d* to prevent the rotating plate 151*e* from being separated from the first spring cover 151*d*. The first spring cover 151*d* is coupled to the spring cap 151*a*, for example, by a screw to adjust the tension of the first elastic member 151.

The second rotating shaft 132 is elastically supported in the axial direction of the first rotating shaft 131 by a second elastic member 152 interposed between the first rotating shaft 131 and the housing 11. A state in which the second rotating shaft 132 is elastically pressed against one side of the first support hole 112 is maintained. The second elastic member 152 applies elastic force indicated by an arrow in FIG. 8.

Accordingly, it is possible to reduce or prevent the trajectory correction accuracy from being lowered since it is loosened due to assembly tolerances in a state in which the second rotating shaft 132 is inserted into the first support hole 112.

Meanwhile, in the housing 110, a through hole is formed at a position corresponding to the second elastic member 152 for the convenience of assembly of the second elastic member 152. A second spring cover 152*a* supports the second elastic member 152 and is assembled to the housing 110 through the through hole.

The adjusting member 140 is inserted into the second support hole 113 of the housing 110 and functions to correct the vertical bullet trajectory by rotating the movable member 120 on which the sight device is installed in the vertical direction in accordance with a distance from the target. The adjusting member 140 includes a rotating body 145 which is provided with one or more polygonal cams (the first and second cams 141 and 142 in the present embodiment) which closely contacts one side of the movable member 120 and adjusts a vertical position of the movable member 120 with the rotation of the adjusting member 140. The adjusting member also includes an adjusting knob 143 which is coupled to one end of the rotating body 145 exposed to the outside of the housing 110. The adjusting member 140 may further include a fixing bolt for fixing the adjusting knob 143 to the rotating body 145 and a cover 146 coupled to the adjusting knob 143 for hiding the head of the fixing bolt.

A rotating support 117 for rotatably supporting the rotating body 145 is disposed on the second support hole 113.

The polygonal cams, that is, the first cam 141 and the second cam 142, are disposed to not overlap each other on the same axis line. Each of the first cam 141 and the second cam 142 includes a plurality of support surfaces formed on the outer circumferential surface thereof, and distances from a central axis 144 to the plurality of support surfaces are different from each other. In other words, the plurality of support surfaces corresponds a plurality of angles between the barrel of the firearm and the sight device D, that is, distances to the target.

Figure 1:
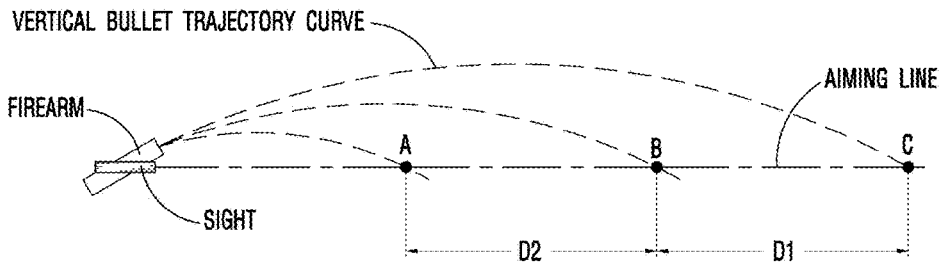
FIG. 1 is a schematic view illustrating a vertical trajectory curve affected by gravity.
Figure 2:
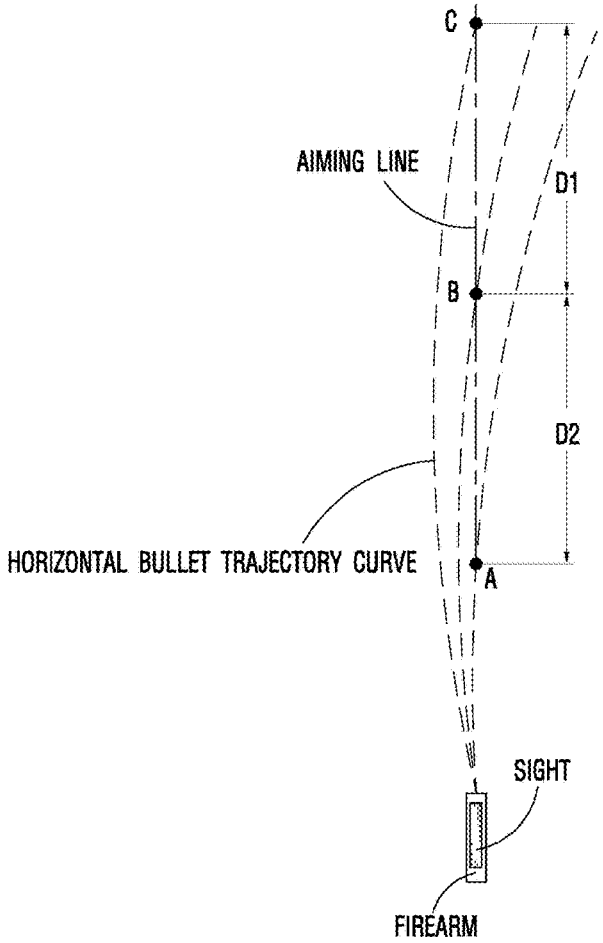
FIG. 2 is a schematic view illustrating a horizontal trajectory curve affected by Coriolis force.

Referring to FIGS. 1 and 2, a shooting range of the firearm may be divided into two ranges D1 and D2. For example, the first cam 141 may used to correct the vertical bullet trajectory when the target is within in the first range D1, and the second cam 142 may used to correct the vertical bullet trajectory when the target is within in the second range D2.

In the present embodiment, the first range D1 and the second range D2 may be divided into six sub ranges, and each of the first cam 141 and the second cam 142 may includes six support surfaces corresponding to the sub ranges to correct the vertical bullet trajectory.

The first cam 141 is disposed on one side of the adjusting member 140 with respect to the central axis 144, and the second cam 142 is disposed on the other side of the adjusting member 140 with respect to the central axis 144.

The adjusting member 140 is rotatable in the assembled state to select one of the first cam 141 and the second cam 142, that is, one of the support surfaces of the first and second cams 141 and 142. For example, in the process of correcting the vertical trajectory using the first cam 141, the second cam 142 is separated from the second guide surface 125 of the movable member 120, whereas in the process of correcting the vertical trajectory using the second cam 142, the first cam 141 is separated from the first guide surface 124 of the movable member 120.

In addition, with the rotation of the adjusting member 140, the support surfaces of the first cam 141 are selected, and then the support surfaces of the second cam 142 starts to be selected.

Here, a distance from the central axis 144 of the adjusting member 140 to the second guide surface 125 is larger than a distance from the central axis 144 of the adjusting member 140 to the first guide surface 124. In other words, the second guide surface 125 is recessed upward relative to the first guide surface 124.

A combination of the support surfaces of the first cam 141 and the first guide surface 124 may be used for the trajectory correction in the first range D1 in FIG. 1, which is a long range. A combination of the support surfaces of the second cam 142 and the second guide surface 125 may be used for the trajectory correction in the second range D2 in FIG. 1, which is a short range.

In this arrangement structure of the first and second guide surfaces 124 and 125, a sufficient contact area is secured between the second guide surface 125 and the support surfaces of the second cam 142 having a smaller trajectory correction value than those of the first cam 141. Here, the trajectory correction value corresponds to a distance from the firearm to the target. For example, as the trajectory correction values, 200 m, 400 m, 600 m, 700 m, 800 m, and 900 m may correspond to the support surfaces of the second cam 142, and 1000 m, 1100 m, 1200 m, 1300 m, 1400 m, and 1500 m may correspond to the support surfaces of the first cam 141.

As the user rotates the adjusting knob 143 in a range of 0° to 180°, the surfaces of the second cam 142 come into contact with the second guide surface 125. As the user rotates the adjusting knob 143 in a range of 180° to 360°, the surfaces of the first cam 141 come into contact with the first guide surface 124 of the movable member 120, and at this time, the surfaces of the second cam 142 are separated from the second guide surface 125.

In the present embodiment, the six support surfaces are formed on the outer circumferential surface of each of the first cam 141 and the second cam 142. For example, the six support surfaces of the first cam 141 are disposed on one side of the rotating body 145 in a range of approximately 0° to 180° about the central axis 144, and the six support surfaces of the second cam 142 are disposed on the other side of the rotating body 145 in a range of approximately 180° to 360°. However, the number of support surfaces of each cam and an angle range of each cam are not particularly limited and may change depending on a use environment of a firearm or a type of firearm.

Figure 15:
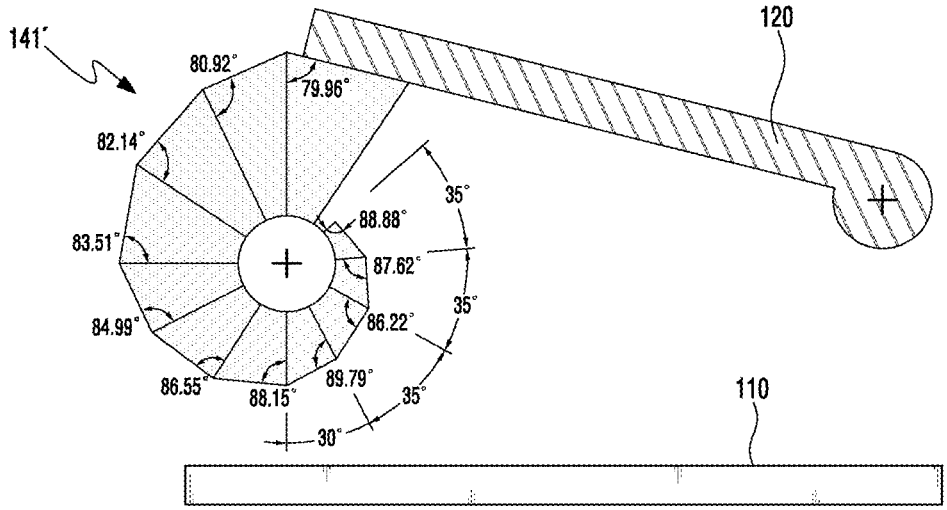
FIG. 15 is a schematic view illustrating a configuration of a polygonal cam of a trajectory correcting device according to an embodiment of the present disclosure.

For example, as illustrated in FIG. 15, a single polygonal cam 141' may include 12 support surfaces on the outer circumference of the rotating body 145 arranged at intervals of 30° about the central axis 144.

As illustrated in FIG. 15, angles formed by the first to eighth support surfaces in the descending order of the trajectory correction values and imaginary lines which extend from the central axis are acute angles, and the eight support surfaces contact the first guide surface 124 or the second guide surface 125 so that the support state is maintained sufficiently and stably.

However, angles formed by the ninth to twelfth support surfaces in the descending order of the trajectory correction values and imaginary lines which extend from the central axis are obtuse angles, and thus the remaining four support surfaces do not maintain the stable support state with the second guide surface 125, and the adjusting member 140 may to rotate to the next support surface.

For this reason, as illustrated in FIG. 15, it is preferable to arrange the ninth to twelfth support surfaces in the descending order of the trajectory correction values at intervals larger than 30° so that angles formed by the ninth to twelfth support surfaces in the descending order of the bullet trajectory correction values and the imaginary lines which extend from the central axis are acute angles.

As the bullet trajectory correction value decreases, the length or the contact area of the support surface decreases.

Particularly, the edge of the boundary between the support surfaces may be worn out over time due to the repetitive use of the polygonal cam, and in this case, the support surface having the small contact area with the guide surface might not maintain a stable support state.

In order to address this, it is preferable that the adjusting member 140 include two or more polygonal cams which are disposed on the rotating body 145 not to overlap each other in the axial direction of the adjusting member 140.

Figure 16:
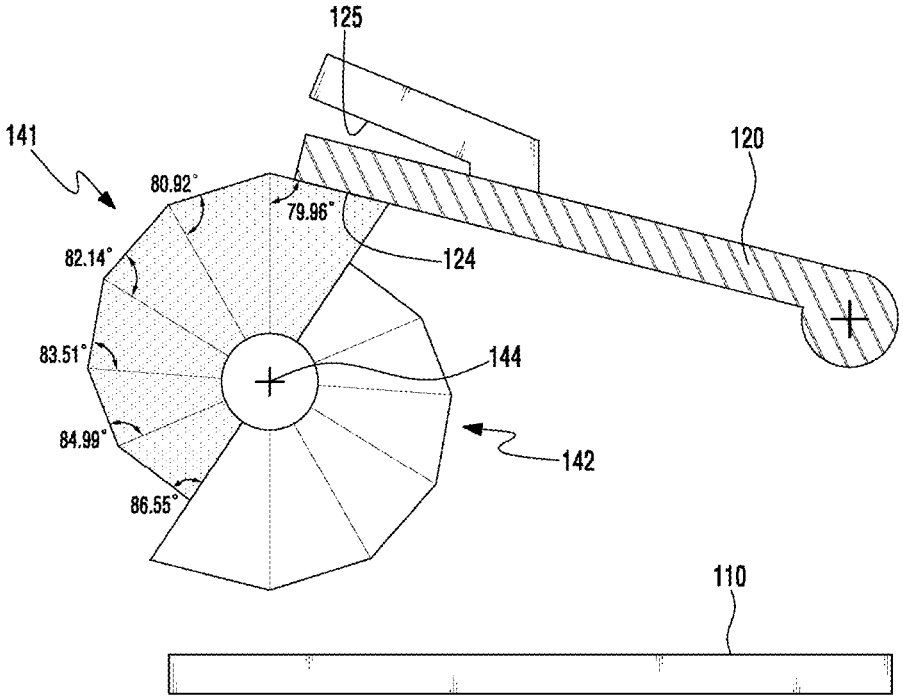
FIG. 16 is a schematic view illustrating another configuration of a polygonal cam of a trajectory correcting device according to an embodiment of the present disclosure.

As illustrated in FIG. 16, the first cam 141 including the six support surfaces whose trajectory correction value gradually decreases is arranged on one side of the rotating body 145 in the range of 0° to 180°, and the second cam 142 including the support surfaces whose bullet trajectory correction value gradually decreases is arranged on the other side of the rotating body 145 in the range of 180° to 360°.

As described above, the second guide surface 125 which the second cam 142 contacts is arranged at a position farther from the central axis 144 of the adjusting member 140 than the first guide surface 124.

In this arrangement, the length or the contact area of the support surface having the smallest bullet trajectory correction value is increased to be larger than in the single polygonal cam illustrated in FIG. 15, and thus the support surface having the smallest bullet trajectory correction value can maintain the stable support state with the guide surface.

The first cam 141 and the second cam 142 are arranged to be apart from each other in the axial direction of the adjusting member 140, and the first guide surface 124 and the second guide surface 125 are disposed at positions corresponding to the first cam 141 and the second cam 142, respectively.

As illustrated in FIG. 17, when the first cam 141 contacts the first guide surface 124 to correct the trajectory, the second cam 142 is separated from the second guide surface 125, and thus the bullet trajectory setting is not changed by the second cam 142.

Similarly, when the second cam 142 contacts the second guide surface 125 to correct the trajectory, the first cam 141 is separated from the first guide surface 124, and thus the bullet trajectory setting is not changed by the first cam 141.

Figure 14A:
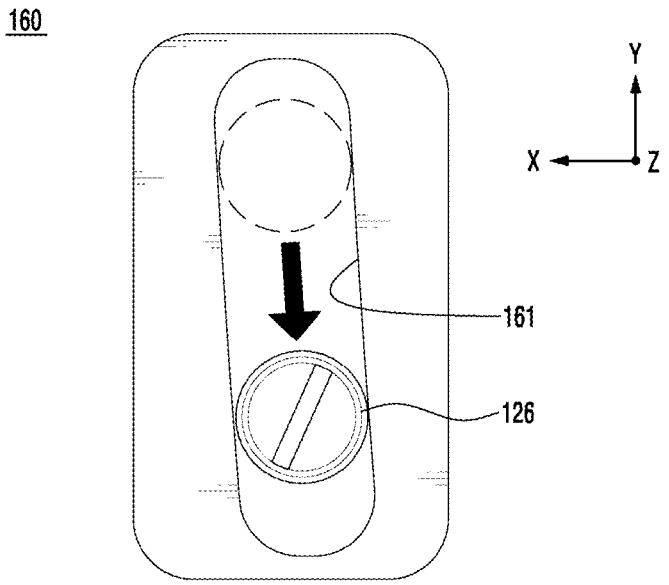
FIGS. 14A and 14B are side views illustrating a guide member of a trajectory correcting device according to an embodiment of the present disclosure.
Figure 14B:
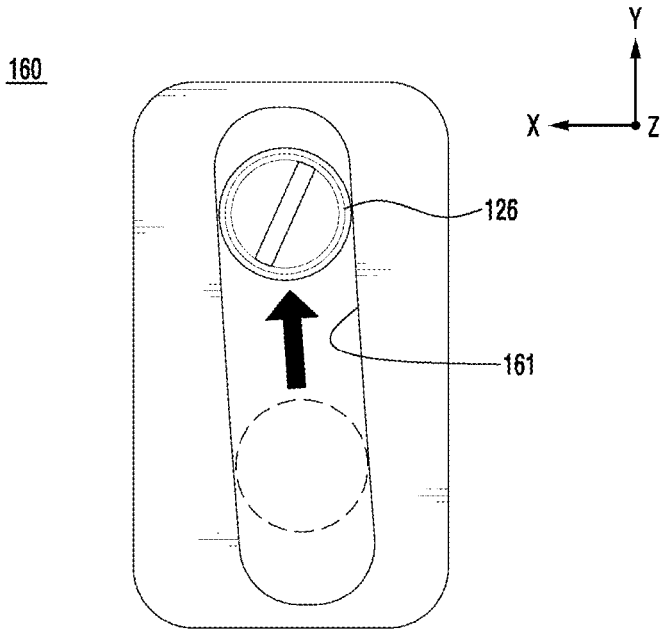

As illustrated in FIGS. 14A and 14B, the guide member 160 decides a left-right position, that is, the horizontal position of the movable member 120 in accordance with the vertical position of the movable member 120 in order to perform the horizontal trajectory correction in accordance with the distance between the movable member 120 and the target. The guide member 160 includes a guide hole 161 which is obliquely formed in the Y axis direction. The guide protrusion 126 coupled to one end of the movable member 120 is inserted into the guide hole 161. Since one end of the movable member 120 is rotatable on the first rotating shaft 131 horizontally, that is, in the X axis direction, the guide protrusion 126 moves up or down along the guide hole 161 with the rotation of the adjusting member 140, and thus the movable member 120 rotates horizontally, that is, in the X axis direction.

The Coriolis force is influenced by the rotation of Earth and works in opposite directions in the northern hemispheres and the southern hemispheres. In the northern hemisphere, the Coriolis force causes the bullet to be deflected rightwards, and in the southern hemisphere, the Coriolis force causes the bullet to be deflected leftwards.

For this reason, for example, when the target is aimed through the sight device in the northern hemisphere, it is necessary to cause the muzzle to be directed toward a position apart leftward from the target.

Further, in the northern hemisphere, as the distance between the sight device and the target increases, a distance at which the muzzle is moved leftwards from the target by the guide member 160 increases.

FIGS. 14 and 14B are illustrated in the case where that the sight device D is used in the northern hemisphere. When the sight device D is used in the southern hemisphere, the guide hole 161 is formed to be oblique in the opposite direction to that illustrated in FIGS. 14A and 14B.

Further, when the guide protrusion 126 is positioned at a lower position in the guide hole 161 as illustrated in FIG. 14A, it corresponds to a short range, that is, the second range D2 in FIG. 2. When the guide protrusion 126 is positioned at a higher position in the guide hole 161 as illustrated in FIG. 14B, it corresponds to a long range, that is, the first range D1 in FIG. 2. Thus, the distance at which the muzzle is moved leftwards from the target by the guide member 160 when the guide protrusion 126 is positioned at a higher position in the guide hole 161 as illustrated in FIG. 14B is larger than the distance at which the muzzle is moved leftwards from the target by the guide member 160 when the guide protrusion 126 is positioned at a lower position in the guide hole 161 as illustrated in FIG. 14A.

A cover 162 may be provided to cover the guide member 160 so that the guide hole 161 is not exposed to the outside.

Figure 12:
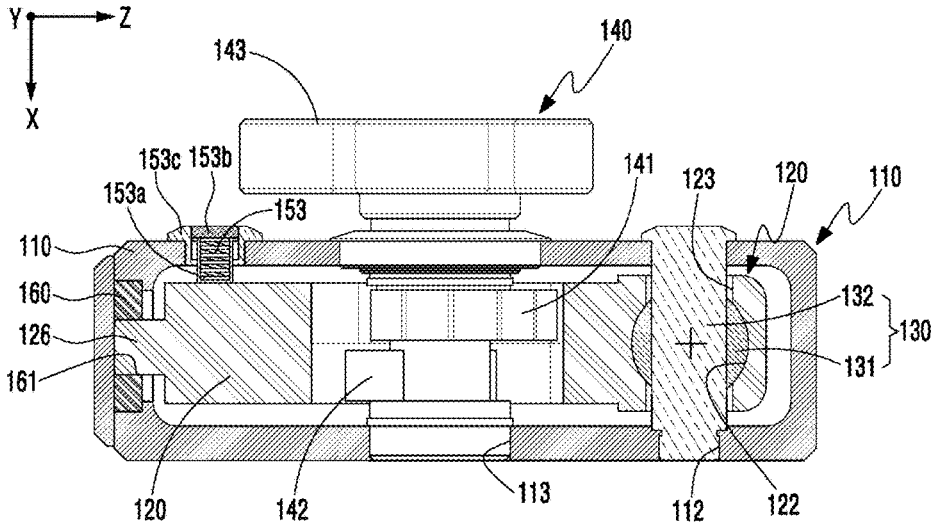
FIG. 12 is a sectional view illustrating a horizontal trajectory correction operation of a trajectory correcting device according to an embodiment of the present disclosure.
Figure 13:
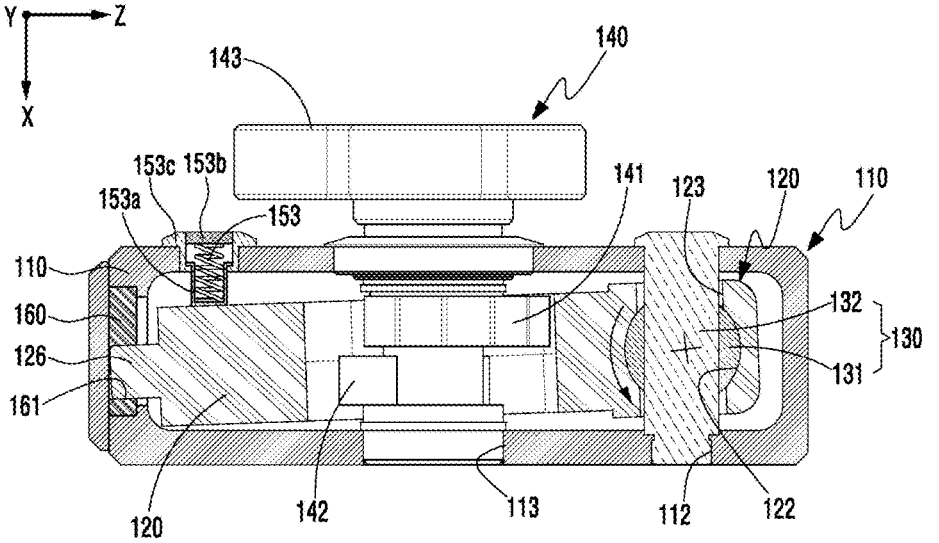
FIG. 13 is a sectional view illustrating a horizontal trajectory correction operation of a trajectory correcting device according to an embodiment of the present disclosure.

As illustrated in FIGS. 12 and 13, a third elastic member 153 is interposed between the movable member 120 and the housing 110 in the first axis (X axis) direction so that the guide protrusion 126 is pressed against one side of the guide hole 161.

A pressing protrusion 153*a* slidably coupled to a spring cap 153*c* coupled to the housing 110 in the first axis (X axis) direction is elastically pressed against the outer surface of the movable member 120 by the third elastic member 153. The rear end of the third elastic member 153 is supported by a third spring cover 153*b* screwed to the spring cap 153*c*. Any other type of spring or any other pressing method can be used as long as it is elastically supported.

The third spring cover 153*b* disposed on one side of the third elastic member 153 may be fixed to the movable member 120. The pressing protrusion 153*a* disposed on the other side of the third elastic member 153 may come into contact with the inner wall surface of the housing 110.

The sealing portion 170 functions to reduce or prevent foreign contaminants from entering the internal space through the opening portion of the housing 110. One side of the sealing portion 170 is fixed to the inner circumferential surface of the opening portion of the housing 110. The other side of the sealing portion 170 is fixed the end portion of the movable member 120 exposed to the outside of the housing 110 through the opening portion.

Therefore, since the opening portion of the housing 110 is sealed by the sealing portion 170, foreign contaminants are reduced or prevented from entering the internal space when the second fixing portion 121 of the movable member 120 moves up, down, left, or right together with the movable member 120.

A vertical bullet trajectory correction operation of the bullet trajectory correcting device according to an embodiment of the present invention will be described below.

FIGS. 8A to 11B are views of the trajectory correcting device taken along the YZ plane for describing the vertical trajectory correction operation according to the present disclosure. FIGS. 8A, 9A, 10A, and 11A are views illustrating a relation between the first cam 141 and the first guide surface 124, and FIGS. 8B, 9B, 10B, and 11B are views illustrating a relation between the second cam 142 and the second guide surface 125.

Figure 8A:
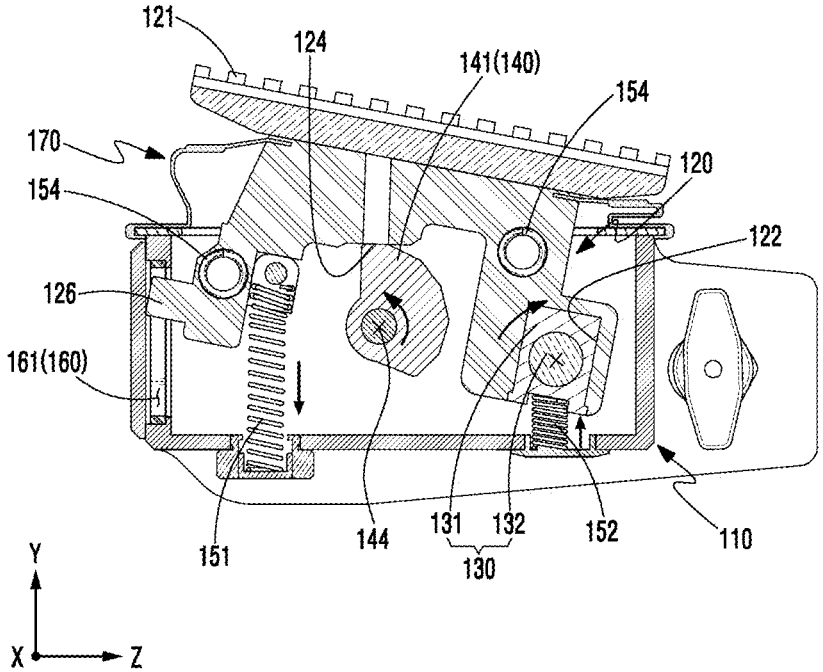
FIGS. 8A and 8B are sectional views illustrating a vertical trajectory correction operation of a trajectory correcting device according to an embodiment of the present disclosure.
Figure 9A:
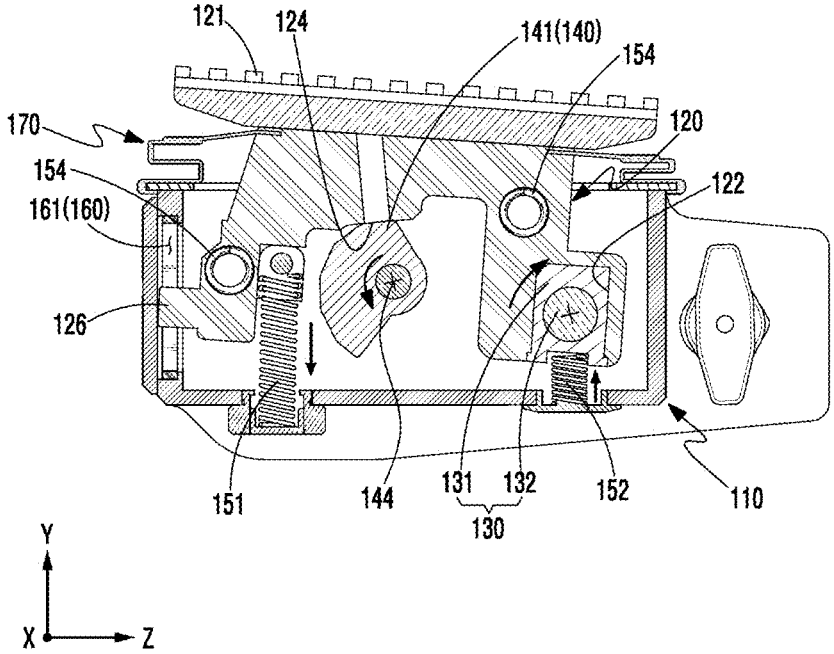
FIGS. 9A and 9B are sectional views illustrating a vertical trajectory correction operation of a trajectory correcting device according to an embodiment of the present disclosure.

FIG. 8A illustrates a state in which the support surface having the largest distance from the central axis 144 among a plurality of support surfaces formed on the first cam 141 comes into contact with the first guide surface 124. FIG. 9A illustrates a state in which the support surface having the smallest distance from the central axis 144 among a plurality of support surfaces formed on the first cam 141 comes into contact with the first guide surface 124.

Figure 17A:
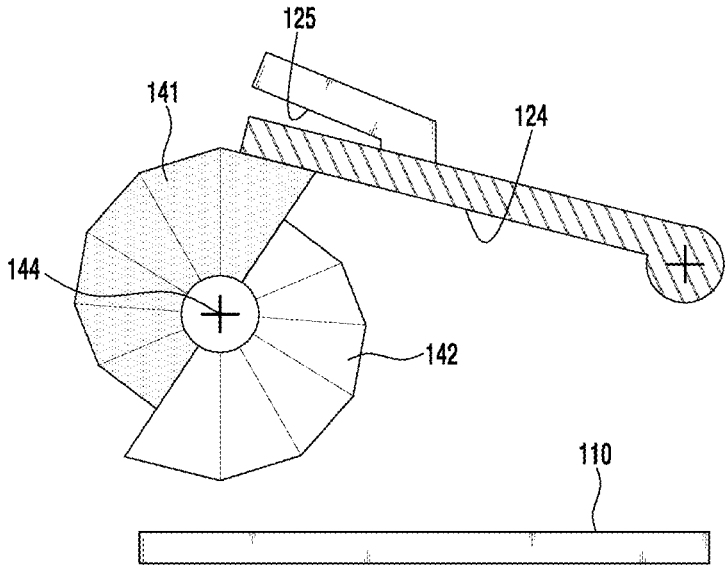
FIGS. 17A and 17B are schematic views illustrating an operation of a first cam in a process of correcting a bullet trajectory.
Figure 17B:
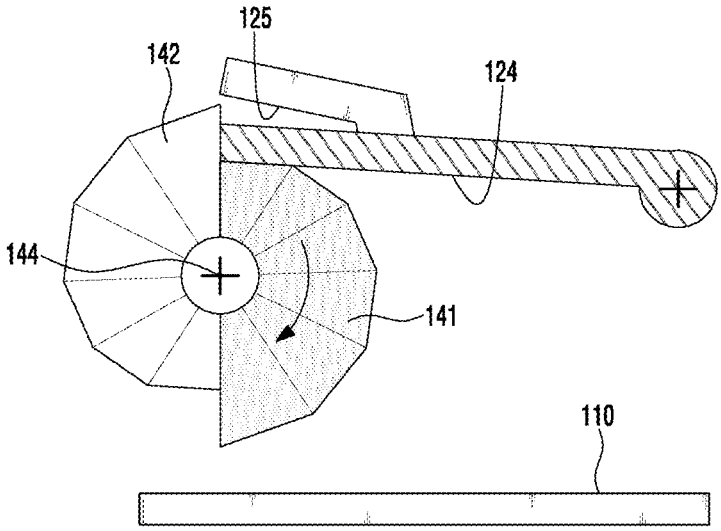

The state illustrated in FIG. 8A corresponds to a state illustrated in FIG. 17A, and the state illustrated in FIG. 9A corresponds to a state illustrated in FIG. 17B.

However, in the state illustrated in FIG. 8A, the trajectory correction value increases counterclockwise, whereas in the state illustrated in FIG. 17A, the trajectory correction value increases clockwise. Similarly, in the state illustrated in FIG. 8B, the trajectory correction value increases counterclockwise, whereas in the state illustrated in FIG. 17B, the trajectory correction value increases clockwise. However, the direction in which the trajectory correction value increases is not particularly limited thereto.

The movable member 120 is connected to the housing 110 by the second rotating shaft 132, which is inserted into the through hole 123 formed on one side of the movable member 120 in the state in which the movable member 120 is disposed in the internal space of the housing 110. In this state, the movable member 120 is rotatable on the second rotating shaft 132 vertically, that is, the Y-axis direction.

The adjusting member 140 is inserted into the second support hole 113 and rotatably installed in the housing 110 at a position spaced apart from the second rotating shaft 132. With the rotation of the adjusting member 140, one of a plurality of support surfaces formed on the outer circumferential surface of the first cam 141 comes into contact with the first guide surface 124, and the vertical rotational position of the movable member 120 is determined in accordance with the distance between the support surface of the first cam 141 and the central axis 144 of the adjusting member 140.

At this time, since the movable member 120 is elastically supported by the first elastic member 151 so that the first guide surface 124 is pressed toward the adjusting member 140, the first guide surface 124 and the support surfaces of the first cam 141 are elastically pressed against each other, and thus the rotational position of the adjusting member 140 is secured against external forces.

Particularly, the adjusting member 140 determines the vertical rotational position of the movable member 120 in accordance with its rotational position, and the vertical bullet trajectory correction according to the distance to the target is performed through this operation.

That is, the first cam 141 determines the vertical rotational position of the movable member 120 within the rotational radius of approximately 0° to 180° out of the rotational radius of 360° of the adjusting member 140, and the second cam 142 determines the vertical rotational position of the movable member 120 within the rotational radius of approximately 180° to 360°.

As described above, the shooting range of the firearm may be divided into two ranges, and in this case, the bullet trajectory for the target in the first range D1, which is the large range, is corrected using the first cam 141, and the bullet trajectory for the target in the second range D2, which is the large range, is corrected using the second cam 142.

In other words, when the distance to the target is decided, and the target is determined to be within the first range D1, the user rotates the adjusting member 140 to select the first cam 141 and the support surface suitable for the distance to the target among a plurality of support surfaces formed on the first cam 141. At this time, the guide protrusion 126 moves up or down along the guide hole 161 with the rotation of the adjusting member 140. Accordingly, the movable member 120 moves vertically and horizontally with the rotation of the adjusting member 140 by the user, so that the vertical bullet trajectory and the horizontal bullet trajectory are corrected at the same time. For example, when the support surface having the largest trajectory correction value is selected, the guide protrusion 126 moves up to the highest position in the guide hole 161 as illustrated in FIG. 14B.

At this time, the third elastic member 153 is disposed between the movable member 120 and the housing 110, the rear end of the third elastic member 153 is supported by the housing 110, and the leading end of the third elastic member 153 is supported by the read end of the pressing protrusion 153*a*, which is slidably movable along the outer wall of the movable member 120. Thus, the guide protrusion 126 is pressed against one inner side of the guide hole 161, and the guide protrusion 126 is secured in the guide hole 161 against being shaken loose due to assembly tolerances.

Figure 8B:
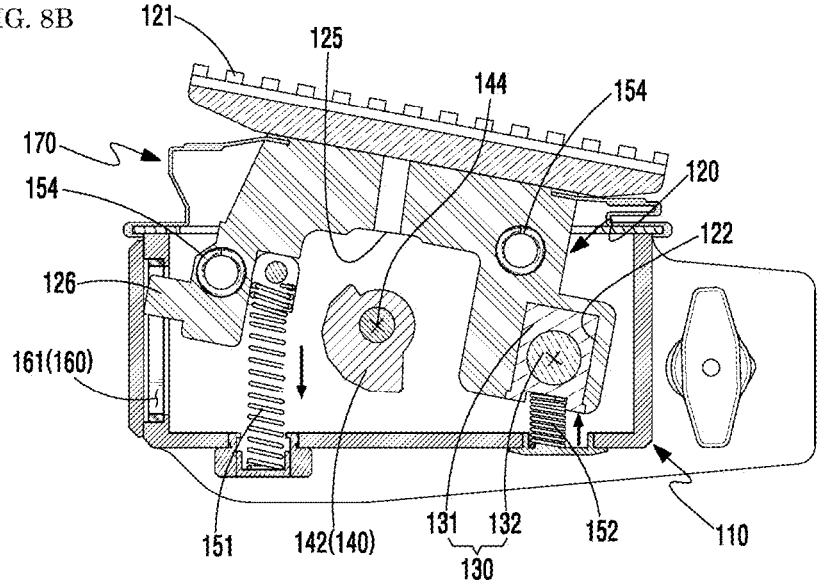
Figure 9B:
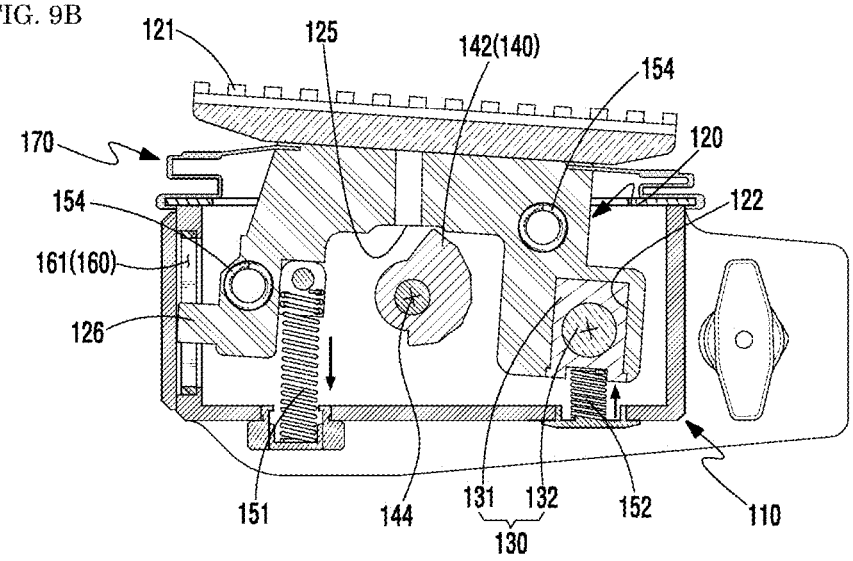

As this time, as illustrated in FIGS. 8B and 9B, while the support surface of the first cam 141 comes into contact with the first guide surface 124, the support surface of the second cam 142 is separated from and does not come into contact with the second guide surface 125 of the movable member 120.

Figure 10A:
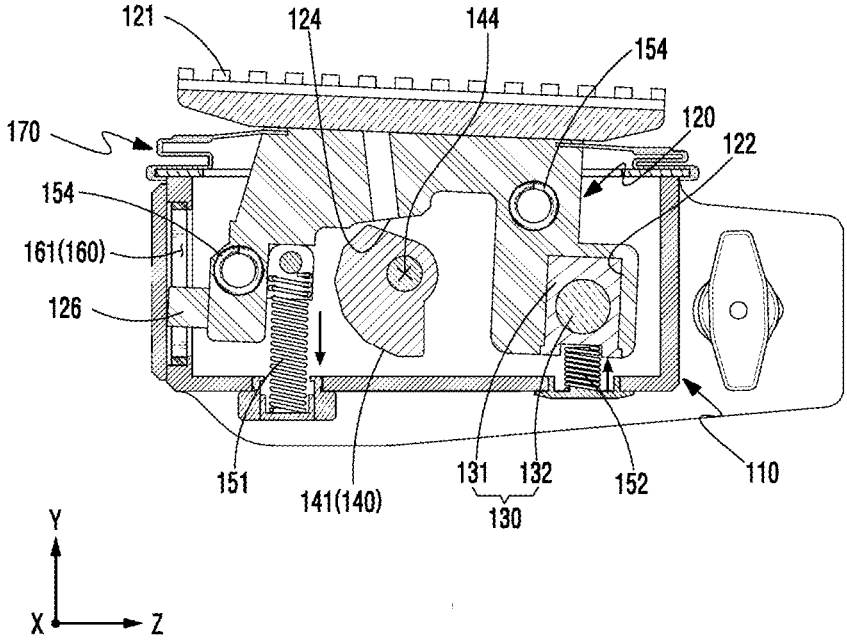
FIGS. 10A and 10B are sectional views illustrating a vertical trajectory correction operation of a trajectory correcting device according to an embodiment of the present disclosure.
Figure 10B:
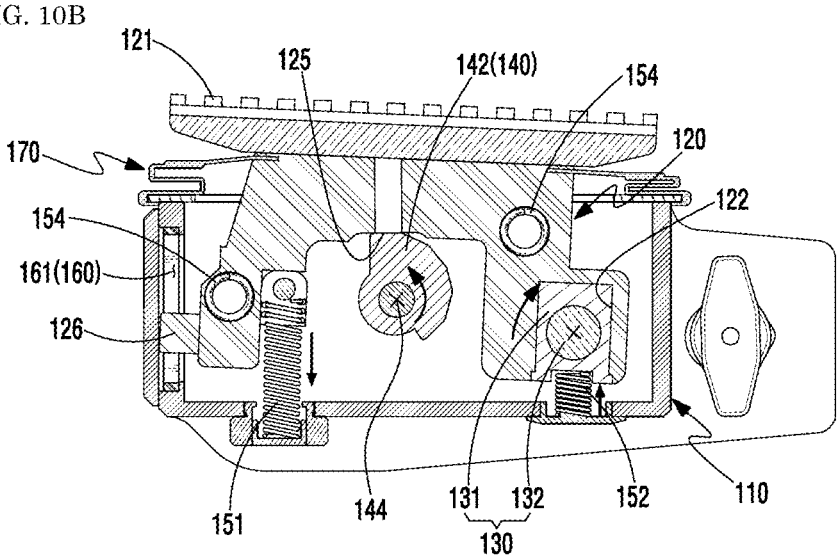

FIG. 10B illustrates a state in which the support surface having the largest distance from the central axis 144 among a plurality of support surfaces formed on the second cam 142 comes into contact with the second guide surface 125. FIG. 11B illustrates a state in which the support surface having the smallest distance from the central axis 144 among a plurality of support surfaces formed on the second cam 142 comes into contact with the second guide surface 125.

Figure 18A:
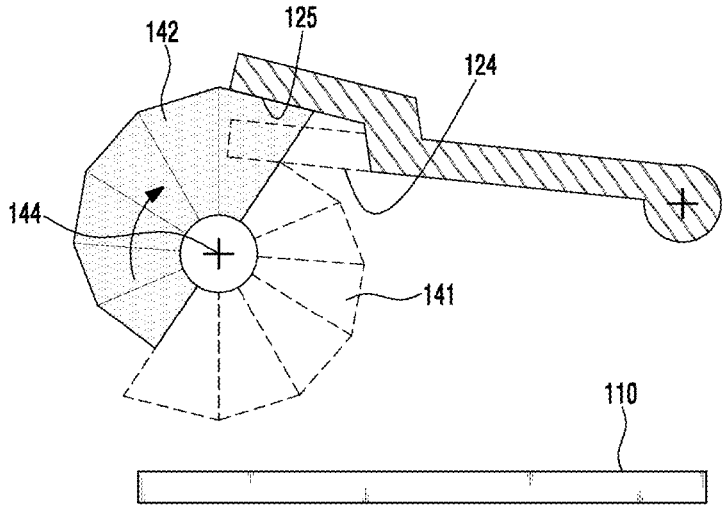
FIGS. 18A and 18B are schematic views illustrating an operation of a second cam in a process of correcting a bullet trajectory.
Figure 18B:
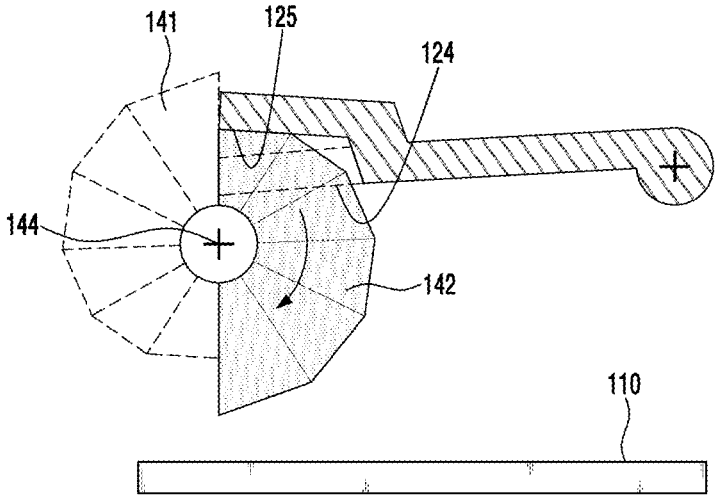

The state illustrated in FIG. 10B corresponds to a state illustrated in FIG. 18A, and the state illustrated in FIG. 11B corresponds to a state illustrated in FIG. 18B.

When the distance to the target is decided, and the target is determined to be within the second range D2, the user rotates the adjusting member 140 to select the second cam 144 and the support surface suitable for the distance to the target among a plurality of support surfaces formed on the second cam 142. At this time, the guide protrusion 126 moves up or down along the guide hole 161 with the rotation of the adjusting member 140. Accordingly, the movable member 120 moves vertically and horizontally with the rotation of the adjusting member 140 by the user, so that the vertical bullet trajectory and the horizontal bullet trajectory are corrected at the same time. For example, when the support surface having the smallest bullet trajectory correction value is selected, the guide protrusion 126 moves down to the lowest position in the guide hole 161 as illustrated in FIG. 14A.

Figure 11A:
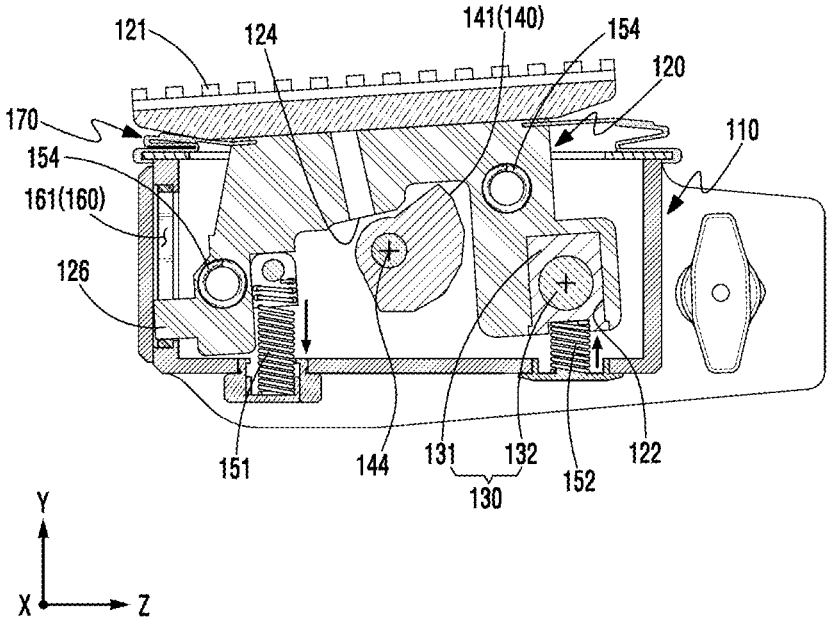
FIGS. 11A and 11B are sectional views illustrating a vertical trajectory correction operation of a trajectory correcting device according to an embodiment of the present disclosure.
Figure 11B:
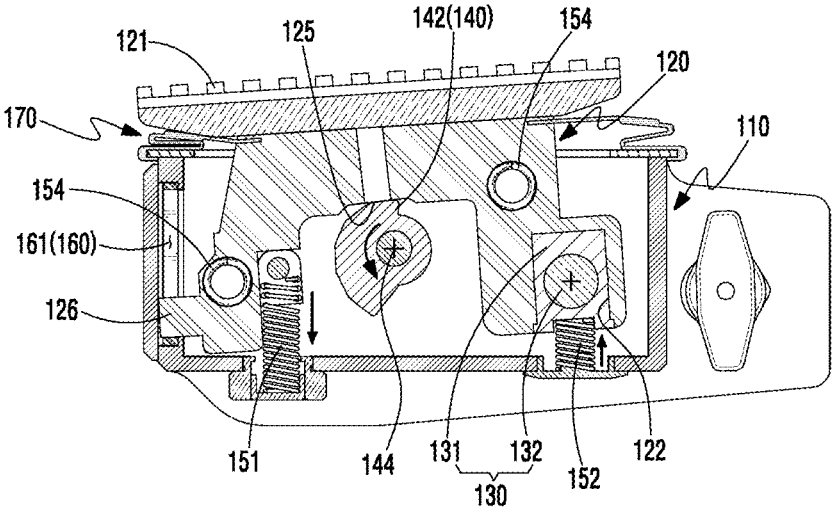

As this time, as illustrated in FIGS. 10A and 11A, while the support surface of the second cam 142 comes into contact with the second guide surface 125, the support surface of the first cam 141 is separated from and does not come into contact with the first guide surface 124 of the movable member 120.

FIGS. 12 and 13 are plane views illustrating the horizontal trajectory correction operation according to the present disclosure. FIGS. 14A and 14B are views illustrating the movement of the guide portion according to the rotation of the adjusting member 140.

FIG. 12 illustrates a state in which the support surface having the smallest trajectory correction value among a plurality of support surfaces formed on the second cam 142 comes into contact with the second guide surface 125, and the movable member 120 is rotated to the lowermost position. In this state, as illustrated in FIG. 14A, the guide protrusion 126 is positioned at the lowermost position of the guide hole 161.

In FIG. 12, for the sake of convenience of description, the second rotating shaft 132, the guide protrusion 126, and the pressing protrusion 153*a* are positioned on the same plane, but it is desirable that the third elastic member 153 be disposed at a position apart from an imaginary line connecting the second rotating shaft 132 with the guide protrusion 126.

In other words, since the movable member 120 is supported by the housing 110 at three points through the second rotating shaft 132, the guide protrusion 126, and the pressing protrusion 153*a*, the movable member 120 is protected from being shaken loose in the housing due to assembly tolerances.

FIG. 13 illustrates a state in which the support surface having the largest bullet trajectory correction value among a plurality of support surfaces formed on the first cam 141 comes into contact with the first guide surface 124, and the movable member 120 is rotated to the uppermost position. In this state, as illustrated in FIG. 14B, the guide protrusion 126 is positioned at the uppermost position of the guide hole 161.

According to the present embodiment, since the horizontal bullet trajectory is simultaneously corrected in the process of correcting the vertical bullet trajectory using the adjusting member 140 in accordance with the distance to the target, the hit accuracy of the sight device can be further improved.

Particularly, since the vertical bullet trajectory and the horizontal bullet trajectory according to the distance to the target can be corrected at the same time by the user simply rotating the one adjusting knob 143, the trajectory correction operation can be performed easily and quickly.

Figure 19A:
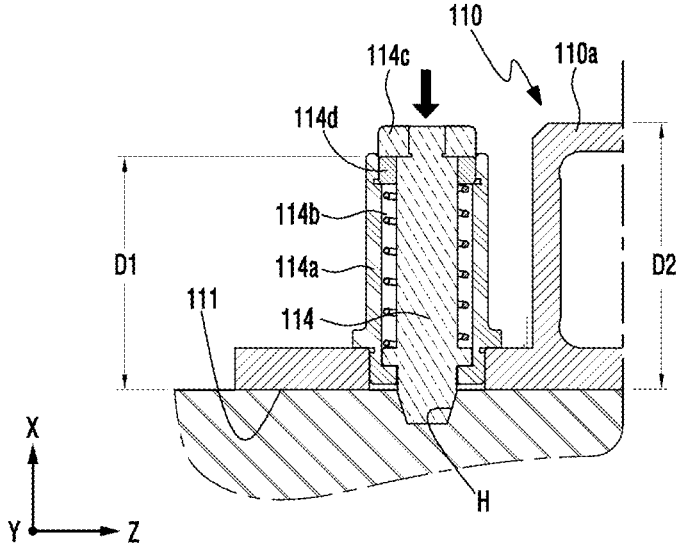
FIGS. 19A and 19B are sectional views illustrating a process of removing or mounting a trajectory collecting device from or on a firearm.
Figure 19B:
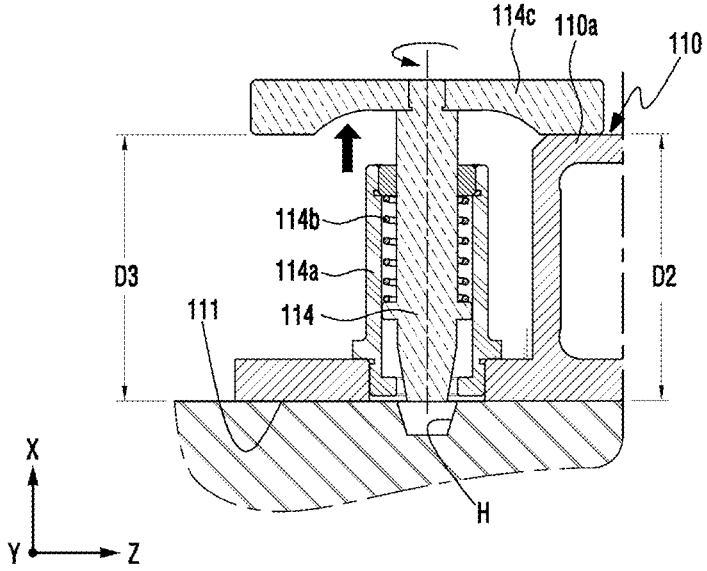

FIGS. 19A and 19B illustrate a method of fixing the trajectory correcting device to the firearm using the fixing shaft. In a state in which the fixing portion 111 slides in the third axis (Z axis) direction and is assembled on the side of the firearm, the fixing shaft 114 is disposed to be movable in the first axis (X axis) direction in the fixing shaft housing 114*a* coupled to the housing 110. The fixing shaft 114 is elastically supported by the elastic member 114*b* interposed between the fixing ring 114*d* and the leading end portion of the fixing shaft 114, as illustrated in FIG. 19A.

In other words, the leading end portion of the fixing shaft 114 is inserted into a recessed portion H of the firearm, and the movement of the housing 110 in the third axis (Z axis) direction is limited.

As illustrated in FIG. 19A, when the leading end of the fixing shaft 114 is inserted into the recessed portion H of the firearm, a distance D1 from the knob 114*c* fixed to the rear end of the fixing shaft 114 to the first fixing portion 111 is smaller than a distance D2 from a side surface of a body portion 110*a* of the housing 110 to the first fixing portion 111.

As illustrated in 19B, when the user pulls the fixing shaft 114 until the leading end of the fixing shaft 114 comes out of the recessed portion H and rotates the knob 114*c* 90° as indicated by an arrow in order to remove the bullet trajectory correcting device from the firearm, the knob 114*c* comes into contact with the side surface of the body portion 110*a* of the housing. Thus the downward movement of the fixing shaft 114 in the X axis direction is limited. At this time, a distance D3 from the knob 114*c* to the first fixing portion 111 is equal to or larger than the distance D2 from the side surface of the body portion 110*a* of the housing 110 to the first fixing portion 111.

In the state illustrated in FIG. 19B, the user can remove the trajectory correcting device from the firearm by sliding the bullet trajectory correcting device in the Z axis direction. Similarly, the state illustrated in FIG. 19B, the user can fix the bullet trajectory correcting device to the firearm by sliding the bullet trajectory correcting device in the Z axis direction. Since the downward movement of the fixing shaft 114 in the X axis direction is limited, the user can easily remove or mount the bullet trajectory correcting device.

In the above example, the bullet trajectory correcting device is mounted on the side of the firearm, but the position at which the bullet trajectory correcting device is mounted is not particularly limited, and for example, the trajectory correcting device may be mounted on the top of the firearm.

The preferred embodiments have been described above with reference to the accompanying drawings, whilst the present invention is not limited to the above examples, of course. A person skilled in the art may find various alternations and modifications within the scope of the appended claims, and it should be understood that they will naturally come under the technical scope of the present invention. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Words of comparison, measurement, and time such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A trajectory correcting device, comprising:

a first mounting member configured to releasably couple with a firearm;

a second mounting member configured to releasably couple with a sight;

a vertical axis being defined as extending in a direction from the first mounting member toward the second mounting member;

a first trajectory adjustment mechanism configured to change an angle between the first mounting member and the second mounting member, the first trajectory adjustment mechanism including:

a cam including a plurality of differently spaced supporting surfaces, a first set of the surfaces distributed circumferentially about the cam at a first axial position, and a second set of the surfaces being distributed about the cam at a second axial position, a first contacting member disposed at a first axial position corresponding to the first axial position of the cam, the first contacting member being configured to respectively contact the first set of the surfaces, and a second contacting member disposed at a second axial position corresponding to the second axial position of the cam, the second contacting member being configured to respectively contact the second set of the surfaces; and a second trajectory adjustment mechanism configured to rotate the second mounting member with respect to the first mounting member about the vertical axis.

2. The trajectory correcting device of claim 1, wherein the first trajectory adjustment mechanism is configured to adjust a vertical trajectory of a projectile fired by the firearm.

3. The trajectory correcting device of claim 2, wherein the second trajectory adjustment mechanism is configured to adjust a horizontal trajectory of the projectile fired by the firearm.

4. The trajectory correcting device of claim 1, wherein the angle between the mounting member and the second mounting member is selected based upon which of the supporting surfaces contacts the respective contacting member.

5. The trajectory correcting device of claim 1, wherein the cam is configured to rotate on an axis.

6. The trajectory correcting device of claim 5, wherein the second adjustment mechanism is configured to rotate in response to the cam rotating on the axis.

7. The trajectory correcting device of claim 1, further comprising a knob operably coupled to both the first trajectory adjustment mechanism and the second trajectory mechanism such that rotation of the knob causes the first and second trajectory adjustment mechanisms to respectively adjust the trajectory at the same time.

8. The trajectory correcting mechanism of claim 1, further comprising a housing and a movable member disposed within the housing, wherein the first trajectory adjustment mechanism is configured to raise and lower at least a portion of the movable member with respect to the housing.

9. The trajectory correcting mechanism of claim 8, wherein the housing includes an angled slot, the movable member includes a protrusion that extends through the slot, and the second trajectory adjustment mechanism is provided at least in part by the protrusion and the slot.

10. The trajectory correcting mechanism of claim 9, wherein when the first trajectory adjustment mechanism raises or lowers the movable member with respect to the housing, the protrusion translates along the angled slot to rotate the movable member and provide horizontal trajectory adjustment.

11. A sighting device, comprising:

a sight that includes a zeroing mechanism that adjusts both and elevation and windage zero point;

a mounting member configured to releasably couple with a firearm;

a movable member coupled between the sight and the mounting member;

a first trajectory adjustment mechanism distinct from the zeroing mechanism and configured to change an angle between the sight and the mounting member, the first trajectory adjustment mechanism including:

a cam including a plurality of differently spaced supporting surfaces, a first set of the surfaces distributed circumferentially about the cam at a first axial position, and a second set of the surfaces being distributed about the cam at a second axial position, a first contacting member disposed at a first axial position corresponding to the first axial position of the cam, the first contacting member being configured to respectively contact the first set of the surfaces, and a second contacting member disposed at a second axial position corresponding to the second axial position of the cam, the second contacting member being configured to respectively contact the second set of the surfaces; and a second trajectory adjustment mechanism distinct from the zeroing mechanism and configured to rotate the sight about an axis different than the adjustment axis of the first trajectory adjustment mechanism.

12. The sighting device of claim 1, wherein the first trajectory adjustment mechanism is configured such that when the cam is at a first rotary position, the first contacting member contacts one of the first set of surfaces.

13. The sighting device of claim 12, wherein the first trajectory adjustment mechanism is configured such that when the cam is at a second rotary position, the second contacting member contacts one of the second set of surfaces.

14. The sighting device of claim 13, wherein the first trajectory adjustment mechanism if configured such that when the cam is at the second rotary position, the first contacting member does not contact the first set of surfaces.

15. The sighting device of claim 11, wherein the first trajectory adjustment mechanism is configured to adjust a vertical trajectory of a projectile fired by the firearm.

16. The sighting device of claim 15, wherein the second trajectory adjustment mechanism is configured to adjust a horizontal trajectory of the projectile fired by the firearm.

17. The sighting device of claim 11, wherein the angle between the sight and the mounting member is selected based upon which of the supporting surfaces contacts the respective contacting member.

18. The sighting device of claim 11, wherein the cam is configured to rotate on an axis, and the second adjustment mechanism is configured to rotate in response to the cam rotating on the axis.

19. The sighting device of claim 18, further comprising a knob operably coupled to both the first trajectory adjustment mechanism and the second trajectory mechanism such that rotation of the knob causes the first and second trajectory adjustment mechanisms to respectively adjust the trajectory at the same time.

20. The sighting device of claim 11, further comprising a housing that includes an angled slot, wherein the movable member includes a protrusion that extends through the slot, and the second trajectory adjustment mechanism is provided at least in part by the protrusion and the slot.

21. The sighting device of claim 20, wherein when the first trajectory adjustment mechanism raises or lowers the movable member with respect to the housing, the protrusion translates along the angled slot to rotate the movable member and provide horizontal trajectory adjustment.

* * * * *